United States Patent [19]

Wenstrup

[11] Patent Number: 4,472,116

[45] Date of Patent: Sep. 18, 1984

[54] INFUSION PUMPING APPARATUS

[75] Inventor: Jan F. Wenstrup, Doylestown, Pa.

[73] Assignee: Air-Shields, Inc., Hatboro, Pa.

[21] Appl. No.: 353,042

[22] Filed: Mar. 1, 1982

[51] Int. Cl.[3] ..... F04B 43/12

[52] U.S. Cl. ..... 417/477; 604/153

[58] Field of Search ..... 417/475–477; 604/153

[56] References Cited

U.S. PATENT DOCUMENTS

| | | | |
|---|---|---|---|
| 3,567,345 | 3/1971 | Ballentine | 417/477 |
| 4,070,725 | 1/1978 | Austin et al. | 417/477 X |
| 4,132,509 | 1/1979 | Bongartz et al. | 417/475 |
| 4,221,543 | 9/1980 | Losentino et al. | 417/477 X |

*Primary Examiner*—Richard E. Gluck

*Attorney, Agent, or Firm*—Weiser, Stapler and Kimmelman

[57] ABSTRACT

Infusion pumping apparatus having shaped rotor fingers (22, 24, 26) which pick up an infusion tube (18) as the rotor (20) rotates to load the tube in the pumping apparatus automatically.

17 Claims, 6 Drawing Figures

INFUSION PUMPING APPARATUS

DESCRIPTION

1. Technical Field

The present invention relates, in general, to pumps and, in particular, to pumping apparatus for the infusion of fluids into the body. As used herein, the term infusion applies both to the introduction of supplementary fluids, such as intravenous medication, intravenous feeding and blood transfusions, and returning body fluids, such as by dialysis and extracorporeal blood circulation.

2. Background Art

The infusion of fluids into the body is accomplished commonly by means of a pump acting upon a tube which carries the fluid. The pump functions to repetitively compress the tube, thereby infusing metered amounts of fluid into the body. The rate of fluid flow through the tube is dependent upon the tube diameter, the rotation rate of the pump rotor, the diameter of the pump rotor and the diameter of rollers typically carried by the pump rotor to engage the tube. Such an arrangement is particularly desirable in that the fluid flow may be controlled quite accurately and the system, being closed, prevents leakage and contamination.

In the past, infusion pumps have been arranged with the pump rotor mounted permanently to the other pump components or in a cassette with the rotor adapted to engage the output shaft of the pump motor when the cassette is inserted into its housing. The cassette arrangement has certain advantages. The rotor tends to collect dirt and the components which contact the tube tend to wear. Cleaning and repair of the rotor is much easier if it can be removed, as when mounted in a removable cassette.

Whether the rotor is permanently mounted to the other pump components or arranged in a cassette, the step of loading the infusion tube in the pump has created certain problems. Some pumps require loading the tube by threading the tube through the pump in a relatively slow and sometimes difficult manner. Other pumps, arranged with movable working surfaces to provide the space required for easier loading of the tube into the pump, generally employ unduly complex mechanisms to facilitate loading the tube.

DISCLOSURE OF THE INVENTION

Accordingly, it is an object of the present invention to provide new and improved infusion pumping apparatus.

It is another object of the present invention to provide a pump rotor which is shaped to permit quick and easy loading of an infusion tube in a pump which forces fluid through the tube.

It is a further object of the present invention to provide such a pump rotor in a cassette which is detachable from the remaining pump components.

It is yet another object of the present invention to provide infusion pumping apparatus which is simple in construction, reliable in operation, easy to maintain and relatively inexpensive to fabricate.

An infusion rotor cassette, constructed in accordance with the present invention, includes a housing having a rotor cavity formed in the outside surface thereof with a working surface which is a portion of a cylinder. The housing also has inlet and outlet passages formed in its outside surface which extend through the housing from the outside surface to two spaced points on the cylindrical working surface. The rotor cavity and the inlet and outlet passages are adapted to contain an infusion tube running through the inlet and outlet passages and along the cylindrical working surface.

A rotor body is mounted for rotation within the rotor cavity on an axis which coincides with the axis of the cylindrical working surface. The rotor body has a plurality of fingers each having a leading edge which is smoothly curved across its thickness joining a peripheral edge which is smoothly curved across its thickness through a connecting surface which is smoothly curved along its length and across its thickness. The rotor body also has an inner wall adjacent the end wall of the cavity and which is spaced axially from the rotor fingers. The outside surface of the rotor fingers project slightly beyond the outside surface of the housing and each of the outside surfaces of the rotor fingers slope down toward the trailing edge of the fingers.

A plurality of rollers are mounted at the periphery of the rotor body between the inner wall of the rotor body and the rotor fingers. These rollers rotate about axes which are parallel to the rotation axis of the rotor body. The rollers are spaced from the cylindrical working surface to squeeze an infusion tube running along the cylindrical working surface between the rollers and the cylindrical working surface.

BRIEF DESCRIPTION OF THE DRAWING

Referring to the drawing.

BEST MODE OF CARRYING OUT THE INVENTION

Figure 3:
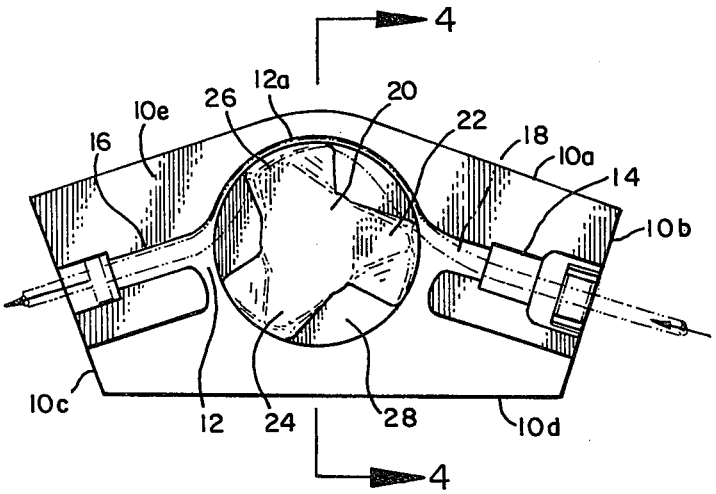
FIG. 3 is a front view of the FIG. 1 cassette.

Referring to the drawing, a rotor cassette, constructed in accordance with the present invention, includes a housing 10 having a rotor cavity 12 formed with a curved working surface 12*a*. As shown, working surface 12*a* is a portion of a cylinder. Housing 10 has a top edge 10*a*, two side edges 10*b* and 10*c*, a bottom edge 10*d*, a front surface 10*e*, and a back surface 10*f*. Rotor cavity 12 is formed as a recess in front surface 10*e* as are an inlet passage 14 and an outlet passage 16 which extend through housing 10 from side edges 10*b* and 10*c*, respectively, to two spaced points on curved working surface 12*a* of the rotor cavity. Inlet passage 14 and outlet passage 16 are adapted to contain an infusion tube 18 shown in phantom in FIGS. 1, 2, 3 and 5 and in solid in FIGS. 4 and 6. Tube 18 preferably is made from a suitable silicone material. When properly loaded, tube 18 extends from inlet passage 14 to outlet passage 16 through rotor cavity 12 along curved working surface 12*a*. As shown most clearly in FIG. 3, inlet passage 14 and outlet passage 16 enter rotor cavity 12 at points approximately 180° apart.

A rotor cassette, constructed in accordance with the present invention, also includes a rotor body 20 mounted for rotation within rotor cavity 12. Rotor 20 has a plurality of fingers 22, 24 and 26 located at three equally spaced angular positions. When viewed in the direction of rotation of the rotor body, counterclockwise for the showing in FIG. 3, each finger on the rotor body has a smoothly curved leading edge joining a smoothly curved peripheral edge through a smoothly curved surface. This is shown most clearly in FIG. 2 where the leading edge, peripheral edge and connecting surface are identified by reference numerals 24*a*, 24*b* and 24*c*, respectively. The outside surface of each rotor finger slopes down toward the trailing edge 24*d* of the finger.

Rotor body 20 also includes an inner wall 28 spaced axially from rotor fingers 22, 24 and 26. Wall 28 and fingers 22, 24 and 26 extend radially outward from a hub 30 of the rotor body to form three angularly spaced yokes. The relationship between inner wall 28 and the rotor fingers is shown most clearly in FIG. 4.

Rotor body 20 is mounted for rotation within cavity 12 with its axis of rotation coinciding with the axis of cylindrical working surface 12*a*. Rotor body 20 is mounted by means of an axial extension 32 of hub 30 which is fitted within a circular bore 34 extending from a rear wall 12*b* of cavity 12 to a recessed portion of back surface 10*f* of housing 10. Extension 32 of hub 30 has a peripheral groove 35 which projects beyond the back surface of the housing and receives a retaining ring 36 for restraining axial movement of the rotor body. In this manner, inner wall 28 of rotor body 20 is located adjacent rear wall 12*b* of cavity 12 and serves as a bearing surface for the rotor body as it is positioned within the rotor cavity. As shown most clearly in FIG. 4, when rotor body 20 is mounted within cavity 12, the outside surfaces of fingers 22, 24 and 26 project slightly beyond front surface 10*e* of housing 10.

Figure 4:
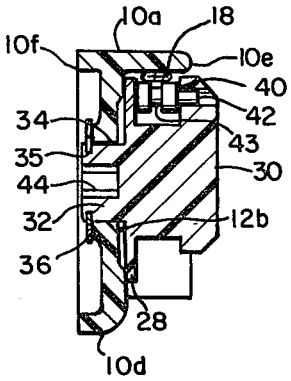
FIG. 4 is a sectional view taken along lines 4—4 of FIG. 3.
Figure 6:
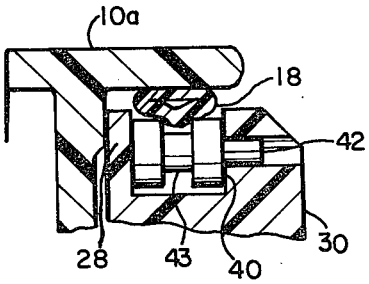
FIG. 6 is an enlarged sectional view of a portion of FIG. 4.
Figure 5:
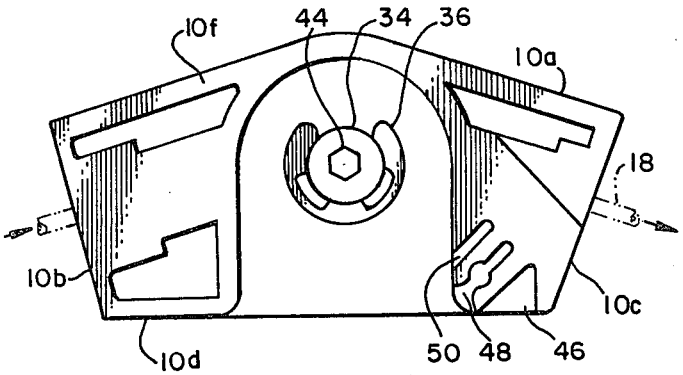
FIG. 5 is a rear view of the FIG. 1 cassette.

A rotor cassette, constructed in accordance with the present invention, further includes a plurality of rollers mounted at the periphery of rotor body 20 for rotation about axes parallel to the rotation axis of the rotor body. One such roller is associated with each rotor finger. In the various views of the drawing, only two rollers 38 and 40, associated with fingers 22 and 26, respectively, are shown. Each roller is mounted in the yoke formed by inner wall 28 and the associated finger by means of a pin 42 which extends between the rotor finger and inner wall 28. The rollers are mounted to be spaced from curved working surface 12*a* so that the rollers squeeze tube 18 running along the working surface between the rollers and the working surface. As shown in FIGS. 4 and 6, each roller has a peripheral groove 43 extending around the circumference of the roller.

In order to impart rotary movement to rotor body 20, an axial bore 44 is provided in hub 30 of the rotor body. This bore, hexagonal in cross-section for the embodiment of the invention illustrated, is adapted to receive the output shaft of a drive motor when the cassette is inserted into its housing.

The back surface of housing 10 has three cutouts 46, 48 and 50 which function to lock the cassette in place when it is inserted into its housing. Cutouts 46 and 50 provide relief so that cutout 48 may flex to receive a slightly oversized pin or stud secured to the cassette housing.

Figure 1:
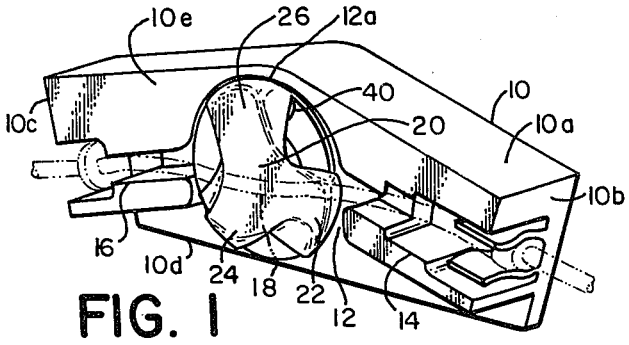
FIG. 1 is a perspective view of a rotor cassette constructed in accordance with the present invention.
Figure 2:
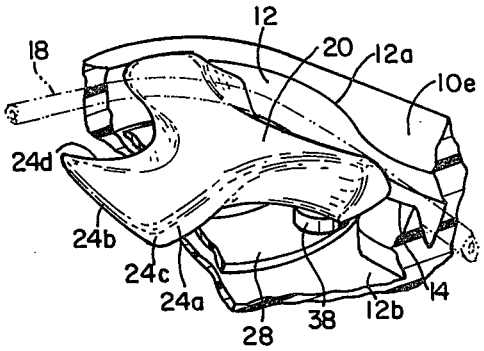
FIG. 2 is an enlarged perspective view of the rotor of FIG. 1.

In operation, the cassette is inserted into its housing with bore 44 receiving the output shaft of the drive motor and cutout 48 receiving the locking pin. After the cassette is in place, infusion tube 18 is snapped into inlet passage 14 and outlet passage 16 with a section of the tube extending across the outside surface of rotor body 20 as shown in FIG. 1. The fitting of tube 18 within passages 14 and 16 and the lubricity of the outside surface of the tube is such that the tube may slide within the passages. Next, the pump motor is turned on and rotor body 20 rotates. As rotor body 20 rotates, the rotor fingers engage tube 18 at the point at which inlet passage 14 enters rotor cavity 12. The shapes of leading edge 24*a*, peripheral edge 24*b* and connecting surface 24*c* are such that they blend together in the region at which the rotor fingers engage tube 18, so that upon impact with the tube, the tube is drawn into the rotor cavity from the position shown in FIG. 1 to the position shown in FIGS. 2, 3, 4 and 6. The smooth contact surfaces of the rotor fingers spread the impact of the fingers on the tube and prevent damage of the tube. Once the tube is loaded and rotor body 20 continues to rotate, the rollers repetitively squeeze the tube as shown in FIG. 4 to drive infusion fluid through the tube in selected amounts determined by the tube diameter, the rotation rate of the rotor body and the diameters of the rotor body and rollers.

The number of rotor fingers and their dimensions and shapes are determined by two factors. First, because the leading edges of the fingers are the surfaces which effectively draw the tube into the rotor cavity, as much space as possible is provided between the fingers to enhance the pick-up of the tube by the fingers. Second, because there is impact between the fingers and the tube, the fingers must have adequate thickness and width to withstand the impact.

Groove 43 in each roller serves to relieve back pressures which build up in tube 18 due to occlusions. The characteristics of tube 18 are such that as infusion fluid in the tube backs up, the tube is able to move into groove 43 of the rollers as the rollers engage the tube. As a result, instead of squeezing tube 18 closed as shown in FIG. 4, the grooved roller permits the bore of the tube 18 to remain open preventing the rollers from forcing additional fluid through the tube. Although groove 43 is shown as having a rectangular cross-section, other shapes may be used. Also, it should be noted that a pressure release groove may be cut into working surface 12*a* instead of using grooved rollers.

For the embodiment of the invention illustrated in the drawing, rotor cavity 12 extends to bottom edge 10*d* of housing 10. This arrangement provides access to rotor body 20 to permit manual loading of tube 18 in case such a feature is desired.

While in the foregoing there has been described a preferred embodiment of the present invention, it should be understood to those skilled in the art that various modifications and changes can be made without departing from the true spirit and scope of the invention as recited in the claims.

What is claimed is:

1. A rotor cassette for pumping infusion fluid through an infusion tube, said cassette comprising:

a housing having a rotor cavity formed in the outside surface thereof with a working surface which is a portion of a cylinder and also having inlet and outlet passages formed in the outside surface thereof extending through said housing from the outside surface of said housing to two spaced points on said cylindrical working surface, said rotor cavity and said inlet and outlet passages adapted to contain an infusion tube running through said inlet and outlet passages and along said cylindrical working surface;

a rotor body mounted for rotation within said rotor cavity on an axis which coincides with the axis of said cylindrical working surface and having (a) a plurality of fingers each having a leading edge smoothly curved across its thickness joining a peripheral edge smoothly curved across its thickness through a connecting surface smoothly curved along its length and across its thickness, and (b) an inner wall adjacent the end wall of said rotor cavity and spaced axially from said rotor fingers, the outside surfaces of said rotor fingers projecting slightly beyond the outside surface of said housing and each of said outside surfaces of said rotor fingers sloping down toward the trailing edge of said rotor fingers;

and a plurality of rollers mounted at the periphery of said rotor body between said inner wall of said rotor body and said rotor fingers for rotation about axes parallel to the rotation axis of said rotor body, said rollers spaced from said cylindrical working surface to squeeze an infusion tube running along said cylindrical working surface between said rollers and said cylindrical working surface.

2. A rotor cassette according to claim 1 wherein the rotor fingers are located at equally spaced angular positions.

3. A rotor cassette according to claim 2 wherein the curved working surface between the inlet and outlet passages has an angular extent of approximately 180°.

4. A rotor cassette according to claim 1 further including pressure release means for relieving back pressures developed in an infusion tube running through the housing.

5. A rotor cassette according to claim 4 wherein the pressure release means include a peripheral groove extending around the circumference of each roller.

6. A rotor cassette according to claim 5 wherein the peripheral groove has a rectangular cross-section.

7. A rotor cassette according to claim 1 wherein the housing has a circular bore extending along the rotation axis of the rotor body from the outside surface of said housing to the rotor cavity and said rotor body has an axial hub fitted within said circular bore to mount said rotor body for rotation within said rotor cavity.

8. A rotor cassette according to claim 7 wherein the rotor body has an axial bore extending through the hub and adapted to receive an output shaft of a motor.

9. A rotor cassette according to claim 8 further including means engaging the rotor body for restraining said rotor body against axial movement.

10. A rotor cassette according to claim 9 wherein the axial hub projects beyond the outside surface of the housing and the restraining means include a retaining ring fitted within a peripheral groove in said axial hub outside said housing.

11. A rotor cassette for pumping infusion fluid through an infusion tube, said cassette comprising:

(1) a housing having:
- (a) top, side and bottom edges,
- (b) front and back surfaces,
- (c) a rotor cavity in said front surface forming a rear wall in said housing between said cavity and said back surface,
- (d) an inlet passage in said front surface extending between a first of said side edges and said rotor cavity, and
- (e) an outlet passage in said front surface extending between a second of said side edges and said rotor cavity;

(2) a rotor body mounted for rotation within said rotor cavity and having:
- (a) a hub,
- (b) a plurality of fingers extending radially outward from said hub at equally spaced angular positions with each finger having a leading edge smoothly curved across its thickness joining a peripheral edge smoothly curved across its thickness through a connecting surface smoothly curved along its length and across its thickness, and
- (c) a bearing wall extending radially outward from said hub and spaced axially from said fingers at a position adjacent said rear wall in said housing;

(3) and a plurality of rollers mounted at the periphery of said rotor body for rotation about axes parallel to the axis of rotation of said rotor body, said rollers spaced from said rotor cavity to squeeze an infusion tube running through said cavity and positioned between said rollers and said cavity.

12. A rotor cassette according to claim 11 wherein the rollers are mounted between the rotor fingers and the bearing wall.

13. A rotor cassette according to claim 12 wherein the outside surfaces of the rotor fingers project slightly beyond the front surface of the housing and each of said outside surfaces of said fingers slopes down toward the trailing edge of said finger.

14. A rotor cassette according to claim 13 wherein the housing has a circular bore extending through its rear wall along the rotation axis of the rotor and an axial extension of the hub is fitted within said circular bore to mount said rotor for rotation within the rotor cavity.

15. A rotor cassette according to claim 14 wherein the axial extension of the hub projects beyond the back surface of the housing and has a peripheral groove and said cassette further includes a retaining ring fitted within said peripheral groove.

16. A rotor cassette according to claim 11 wherein the rotor cavity has a surface extending between the inlet and outlet passages which is a portion of a cylinder having an axis which coincides with the rotation axis of the rotor body.

17. A rotor cassette according to claim 16 wherein the rotor cavity extends to the bottom edge of the housing.

* * * * *